US011519209B2

(12) United States Patent
Terno

(10) Patent No.: US 11,519,209 B2
(45) Date of Patent: Dec. 6, 2022

(54) SLIDING DOORS FLOOR HANDLING DEVICE

(71) Applicants: TERNO SCORREVOLI S.P.A. UNIPERSONALE, Varedo (IT); Nicola Ballotta, Marano sul Panaro (IT)

(72) Inventor: Giovanni Terno, Varedo (IT)

( * ) Notice: Subject to any disclaimer, the term of this patent is extended or adjusted under 35 U.S.C. 154(b) by 237 days.

(21) Appl. No.: 16/630,609

(22) PCT Filed: Jul. 20, 2018

(86) PCT No.: PCT/EP2018/000365
§ 371 (c)(1),
(2) Date: Jan. 13, 2020

(87) PCT Pub. No.: WO2019/029838
PCT Pub. Date: Feb. 14, 2019

(65) Prior Publication Data

US 2020/0157865 A1 May 21, 2020

(30) Foreign Application Priority Data

Aug. 7, 2017 (IT) ..... 102017000091124

(51) Int. Cl.
*E05D 15/06* (2006.01)

(52) U.S. Cl.
CPC ..... *E05D 15/0665* (2013.01); *E05D 15/0669* (2013.01); *E05Y 2201/688* (2013.01); *E05Y 2800/422* (2013.01); *E05Y 2900/132* (2013.01)

(58) Field of Classification Search
CPC ..... Y10T 16/3834; Y10T 16/384; E05D 15/0669; E05D 15/0665; E05D 15/066
See application file for complete search history.

(56) References Cited

U.S. PATENT DOCUMENTS 3,090,084 A * 5/1963 Banner ..... E05D 15/066 49/420
3,283,444 A * 11/1966 Andres ..... E05D 15/0669 49/420

(Continued)

FOREIGN PATENT DOCUMENTS

| | | | |
|---|---|---|---|
| DE | 1269537 | B | 7/1936 |
| EP | 2646635 | B1 | 1/2017 |
| WO | 2016027062 | A1 | 2/2016 |

OTHER PUBLICATIONS

International Search Report, dated Nov. 26, 2018 for corresponding PCT patent application No. PCT/EP2018/000365.

(Continued)

*Primary Examiner* — Justin B Rephann
(74) *Attorney, Agent, or Firm* — Steven Hertzberg

(57) ABSTRACT

A sliding doors floor handling device (20) for sliding wooden doors (10) or glass doors (72), placed next to a wall (16) and provided at the bottom with a guide (82) combined with a pin (14) protruding from the floor (48), comprises a containment shell (26), substantially parallelepiped in shape, pardy open along the upper base, in which a fork-shaped frame (44) is arranged. The parallel sections (64) of the frame (44) are provided with a hole (52) for inserting a pin (54) that supports a wheel (46) designed to touch the floor (48) when rolling. The fork-shaped frame (44) is provided with one or more elastic sheets (60) secured to the shell (26).

8 Claims, 7 Drawing Sheets

(56) References Cited

U.S. PATENT DOCUMENTS 3,299,575 A * 1/1967 Du Shane ..... E05D 15/0669 49/420
3,442,052 A * 5/1969 Levine ..... E05D 15/0669 49/425
3,512,209 A * 5/1970 Povoden ..... E05D 15/0669 16/105
3,670,357 A * 6/1972 Steigerwald ..... E05D 15/0669 16/105
3,716,890 A * 2/1973 Benson ..... E05D 15/0669 16/91
3,722,028 A * 3/1973 Schoenbrod ..... E05D 15/063 16/91
3,731,431 A * 5/1973 Banner ..... E05D 15/0669 49/420
4,030,160 A * 6/1977 Lambertz ..... E05D 15/0669 16/105
4,112,622 A 9/1978 Stewart
4,189,870 A * 2/1980 Helmick ..... E05D 15/0669 16/105
4,353,186 A * 10/1982 Offterdinger ..... E05D 15/0669 16/105
4,559,669 A * 12/1985 Bonzer ..... B60B 33/045 16/44
4,805,262 A * 2/1989 Marshik ..... E05D 15/0691 16/105
4,873,741 A * 10/1989 Riegelman ..... E05D 15/0669 16/105
4,899,493 A * 2/1990 Baumgarten ..... E05D 15/0665 16/91
5,448,796 A * 9/1995 Larson ..... B60B 33/045 16/44
5,791,089 A * 8/1998 Prevot ..... E05D 15/0669 49/425
7,293,389 B2 * 11/2007 Jacobs ..... E05D 15/0691 16/91
9,611,684 B2 * 4/2017 Zimmer ..... E05D 15/0669
2004/0055108 A1 * 3/2004 Lemeur, Jr. ..... B60B 33/045 16/44
2005/0011041 A1 * 1/2005 Ness ..... E05D 15/0669 16/105
2006/0185121 A1 * 8/2006 Hilger ..... E05F 7/06 16/102
2016/0159616 A1 * 6/2016 Rasanen ..... B66B 13/30 187/319

OTHER PUBLICATIONS

Written Opinion of the International Search Authority, dated Nov. 26, 2018 for corresponding PCT patent application No. PCT/EP2018/000365.

* cited by examiner

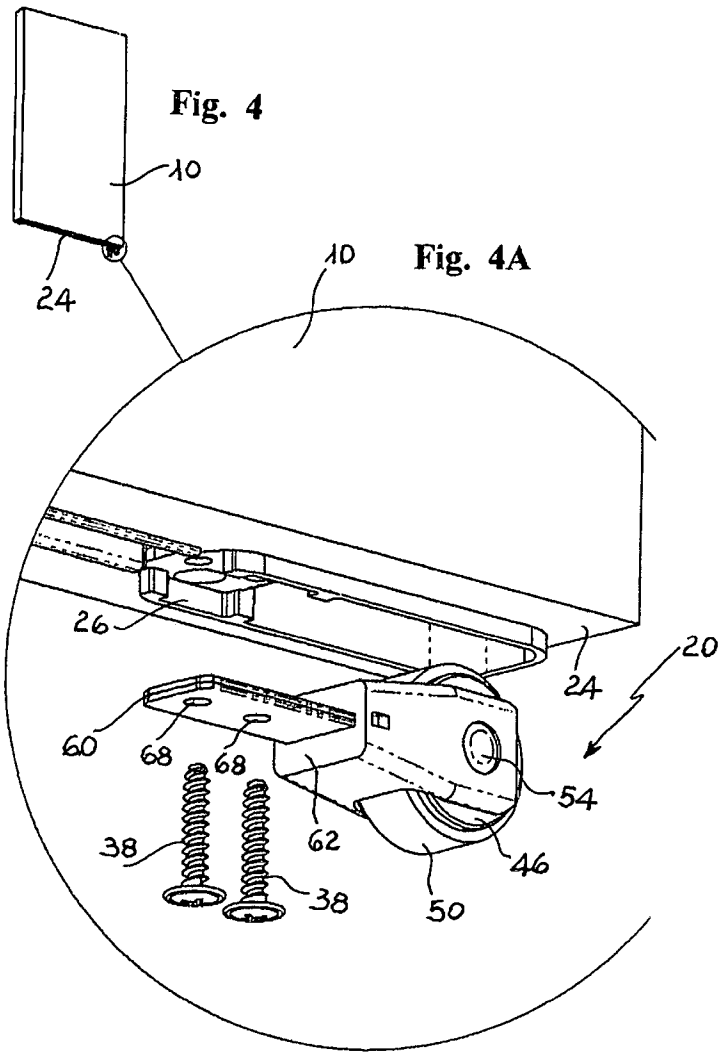
Fig. 4
Fig. 4A
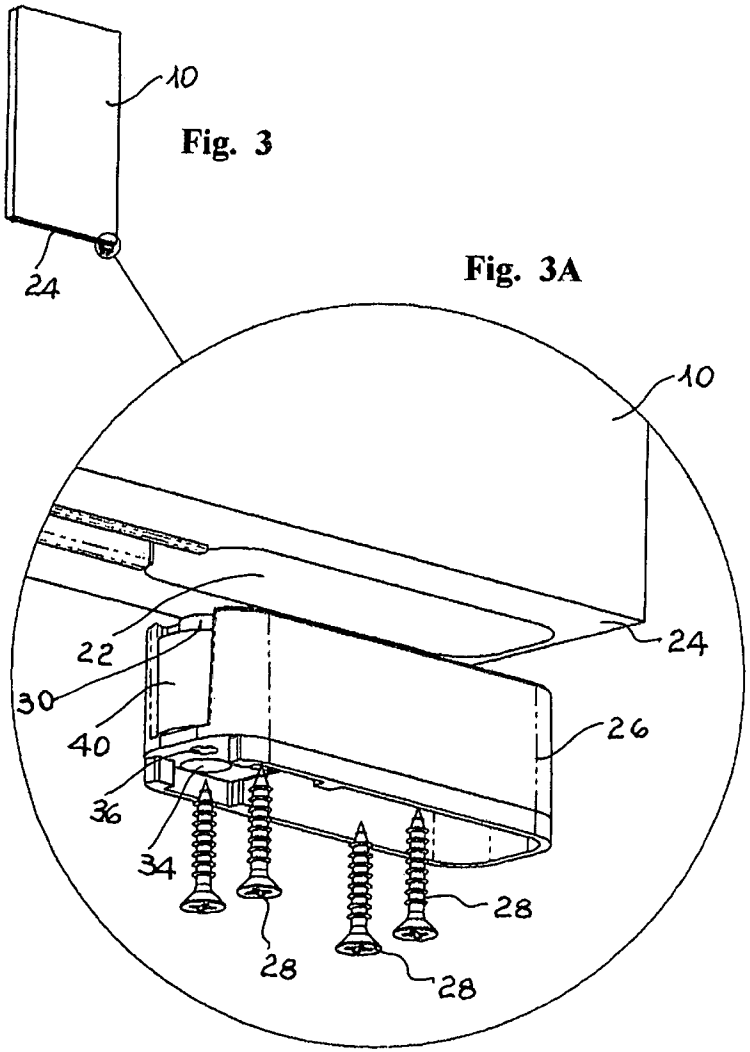
Fig. 3
Fig. 3A

DETAIL A
SCALE 3:2
DETAIL A
SCALE 3:2
10
26
46
50
54
42
44
38
38
60
40
48
10
26
46
50
54
42
44
60
40
38
48
10
48

SLIDING DOORS FLOOR HANDLING DEVICE

CROSS REFERENCE TO RELATED APPLICATIONS

This application is a national phase of PCT application No. PCT/EP2018/000365, filed Jul. 20, 2018, which claims priority to IT patent application No. 102017000091124, filed Aug. 7, 2017, all of which are incorporated herein by reference thereto.

This invention relates to a sliding doors handling device.

More particularly, this invention relates to a device as defined above, especially suitable to allow the correct handling on the lower front of the doors that, on the opposite side, slide by means of carriages along an upper guide generally secured to the wall.

It is known that the sliding doors installed to allow the separation between two rooms are more and more widespread according to their practicality, since they do not require cantilevering spaces for opening and, in certain solutions, they are inserted, so disappearing, into a seat included between the opposite sides of the wall. Depending on these characteristics, the sliding doors are also appreciated from an aesthetic point of view, and are used not only in residential areas, but also in offices and commercial premises. To make the sliding of these doors possible and easy, specific devices have been designed, comprising carriages that are handled along an upper guide secured to the wall and, at the same time, secured to the upper end or header of the door to be handled; the connection between the carriages and the door is made, according to a known solution, through an appendage integral with the lower part of each carriage, which projects from a slot extending longitudinally in the aforesaid guide. Said appendage on its free end has a plate or the like that, by means of screws or equivalent retaining means, is secured to the door.

As an alternative, the door is provided, on the internal side facing the wall, with a shaped profile section whose upper part defines an embossed profile section complementary to that of a pair of wheels or rollers of a fixed carriage, i.e. secured to the wall; the door is then hooked to said rollers and its handling for opening and closing is achieved by sliding the section on the wheels or rollers of the fixed carriage. This second and also known embodiment is even more advantageous given that the device as a whole remains hidden from view, except for a plastic cap that closes both opposite headers of the profile section. In both the first and second hypotheses, an opposed lower guide completes the device; it is secured to the floor and is defined by an appendage protruding like a pin or the like that, reaching upwards, inserts and engages along a longitudinal slot, specially obtained at the lower end of the door. The sliding of the door on the upper side takes place precisely and easily, given the presence of the aforementioned devices that, in addition to the carriages, also comprise means for controlling and braking the door, as well as for preventing accidental overriding of the guide that defines the sliding line.

On the opposite lower side, on the other hand, the guided handling of the door is entrusted only to the appendage that protrudes from the floor and that cooperates with the longitudinal slot along the lower edge of the door itself. This solution involves significant drawbacks, which are, for example, the formation of gaps; in fact, with the passage of time, an imprecise and difficult sliding can occur, also as a function of the variable weight of the door, which can be relevant if it is a glass door. The relevant weight, which may derive from the use of solid wood or glass to manufacture the door, may give rise during the sliding of the door itself to significant vertical thrusts that are not amortized by anything. In order to overcome these drawbacks, a floor sliding door mechanism has been devised, described in EP 2 646 635, which provides, in addition to the floor appendage, engaged in the longitudinal slot of the door or in a metal guide arranged in said slot, the use of a fork support for a wheel; between the support and the wheel, at least one flexible plate is interposed acting as a spring; depending on the weight of the door, the use of a greater or lesser number of such plates is envisaged. The wheel is housed in a seat formed along the lower edge of the door, from which it protrudes partly to roll along the floor and facilitates handling of the door at the lower end. Overall, it is a mechanism that improves the sliding of the door compared to the traditional solution mentioned above, at least partly absorbing the vertical thrusts due, for example, to the irregularities of the floor or the presence of large joints between a tile and the other.

However, it has been noted that this solution also shows a series of drawbacks, both of operation and connected to the assembly of the mechanism on the door. A first drawback, in the case of wooden doors, concerns the fact that the mechanism with the wheel, arranged in the seat formed at the base of the door itself, is constantly subjected to stresses and vertical thrusts, which are absorbed only by the elastic sheet and that, however, determine an appreciable level of noise; therefore, depending on the type of more or less heavy door as well as the type of more or less smooth floor, it is necessary to use a greater or lesser number of said sheets, which, during assembly of the mechanism, are interposed between the relevant support and the wheel. A further drawback concerns the possibility that the mechanism with the wheel and the door as a whole suffer violent shocks reaching the end of stroke, with the consequent risk that such shocks may negatively affect not only said mechanism, but also the sliding devices placed above. In the solution described in the aforementioned European patent, moreover, the mechanism comprising the wheel requires particular attention when it is mounted on the door; this operation is laborious, being, among other things, required the use of a specific spacer to be prepared and secured to the door itself. Moreover, if the mechanism as a whole is not correctly mounted in the seat created on the door, taking into account the correct sense of insertion in the same seat, its operation can easily be unsatisfactory if not completely compromised. In this case, the need to disassemble the whole assembly, also disengaging the door from the upper guides to intervene on it along the lower edge that accommodates said mechanism, involves a long and laborious restoration of the correct functionality, thus leading to a significant increase in installation costs.

EP 2,646,635 discloses the solution of manufacturing a sliding door comprising a door able to move between two end opening and closing positions; said door is provided with means for supporting and guiding the door, which, in turn, comprise rotating elements for slidably supporting longitudinal guide devices, secured above the door and also associated with its lower edge.

DE 1269537 describes a device for moving sliding doors comprising a containment shell, a fork frame, a wheel and an elastic plate secured to the shell. Said sheet, which has the function of allowing rapid assembly of the device, by blocking the skid, does not perform any function of absorbing the stresses that occur when the door slides.

The object of the present invention is to obviate the aforementioned drawbacks.

More particularly, the purpose of this invention is that of providing a sliding doors floor handling device that allows to absorb the stresses and the vertical thrusts in an optimal manner, thus eliminating at the same time the discomfort deriving from a high level of noise.

A further purpose of the invention is to provide a device as defined above that is able to prevent the door from being subjected to violent shocks reaching the end of stroke.

Not least purpose of the invention is to provide a sliding doors floor handling device, which can be installed in an easy and rapid manner, away from any malfunctions deriving from incorrect assembly.

A further purpose of the invention is to provide a device suitable for use both for wooden doors and glass or crystal ones.

A further purpose of the invention is to provide users with a sliding doors floor handling device, designed to guarantee a high level of resistance and reliability over time, such as to be easily and economically manufactured.

These and still other purposes are achieved by the sliding doors floor handling device of this invention, according to the main claim.

The constructive and functional characteristics of the device of this invention can be better understood from the detailed description below, in which reference is made to the attached tables of drawings showing a preferred and non-limiting embodiment thereof and in which:

FIG. 3 shows schematically the same door in an axonometric view and on a reduced scale;

FIG. 3A is a partial enlargement of FIG. 3, showing a component of the device of the invention and its housing seat along the lower edge of the door;

FIG. 4 shows schematically the same door in an axonometric view and on a reduced scale;

FIG. 4A is a schematic exploded view of the device of the invention, of the overlying door and of the component of FIG. 3A;

Figure 1:
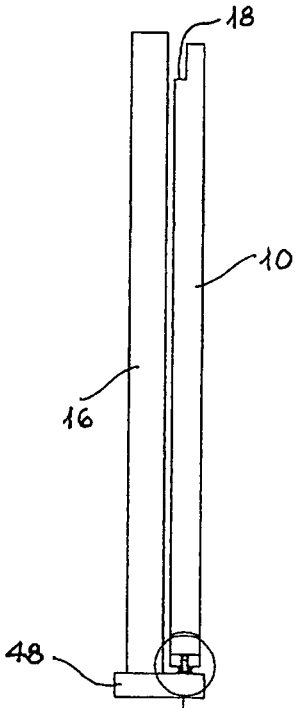
FIG. 1 is a schematic side view of a door next to a wall and provided below with the traditional seat in which the appendage protruding from the floor extends.
Figure 2:
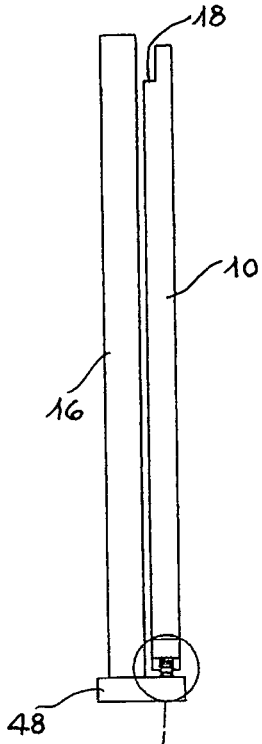
FIG. 2 is a schematic side view of the door next to a wall and provided below with the handling device of this invention.
Figure 1A:
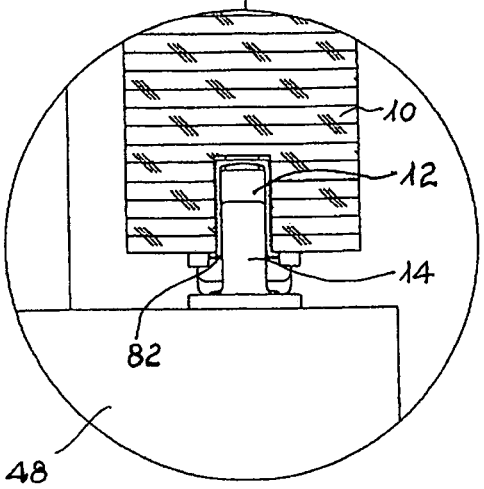
FIG. 1A is a partial magnification of FIG. 1.
Figure 2A:
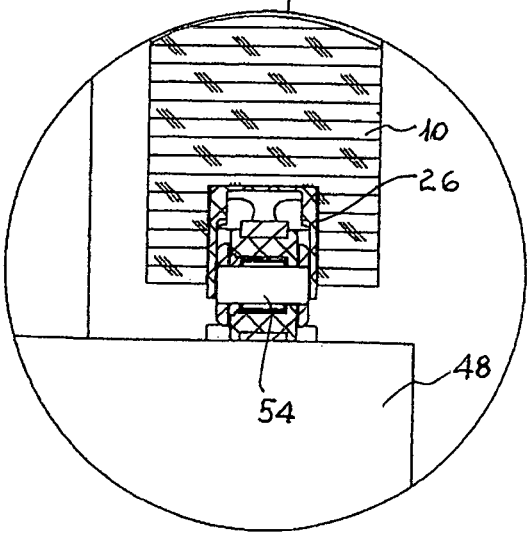
FIG. 2A is a partial magnification of FIG. 2.
Figures 5, 5A, 6, 6A:
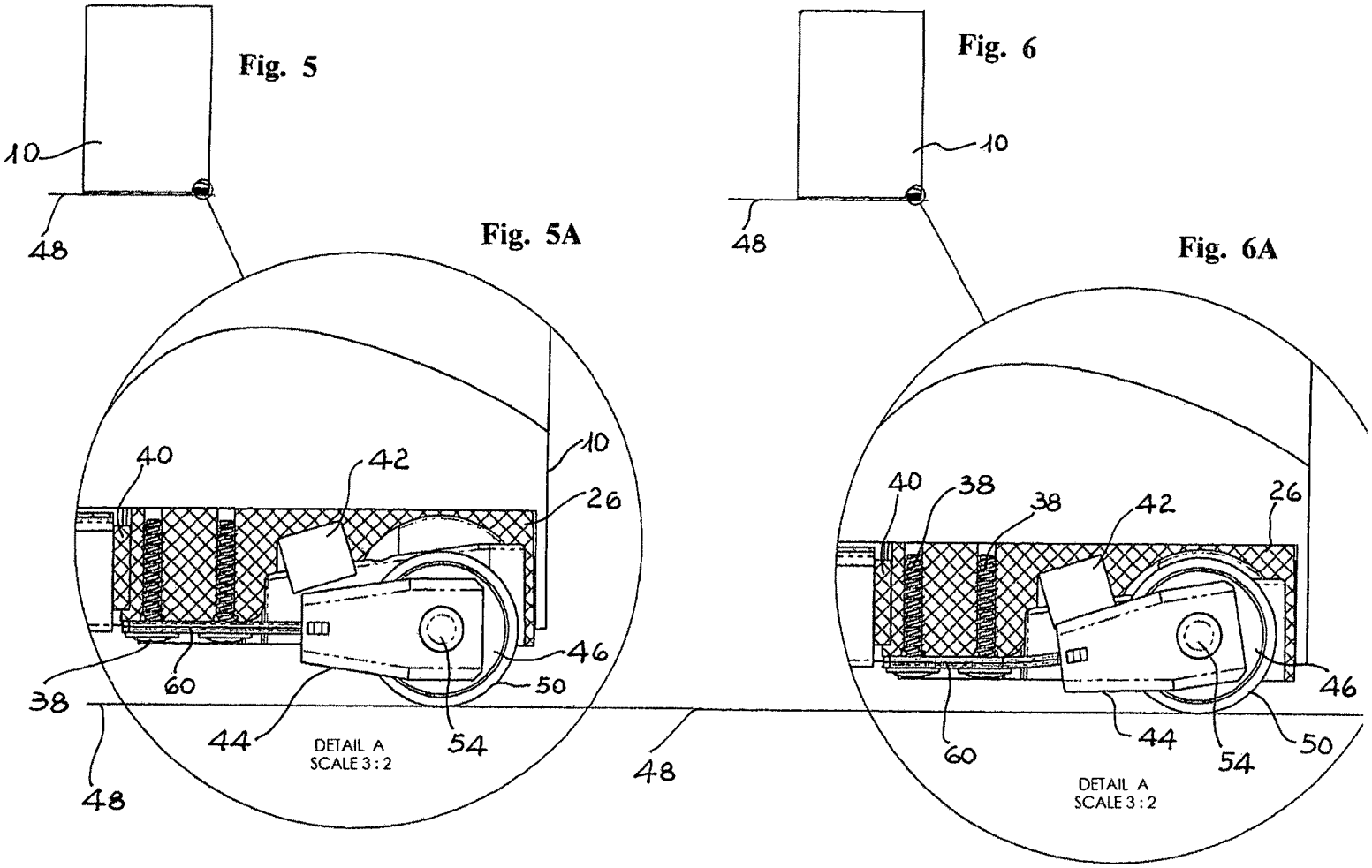
FIGS. 5 and 6 show schematically the same door of FIGS. 3 and 4.
Figure 7:
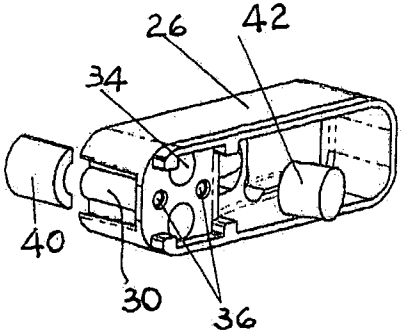
Figure 8:
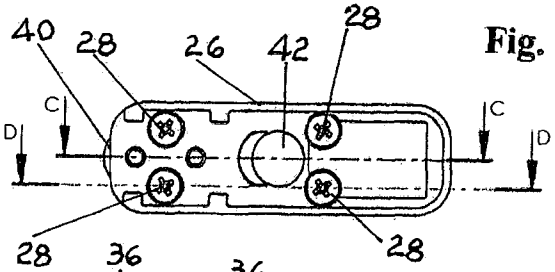
Figure 9:
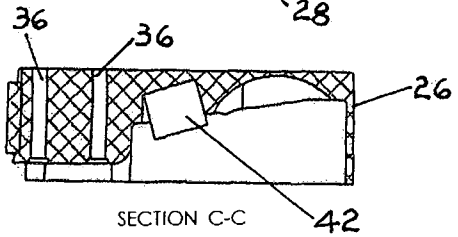
Figure 10:
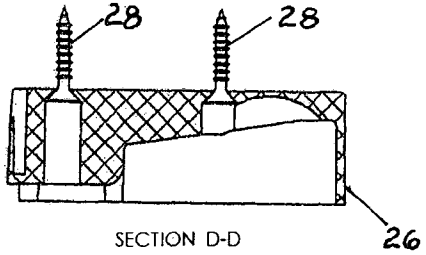
Figure 13:
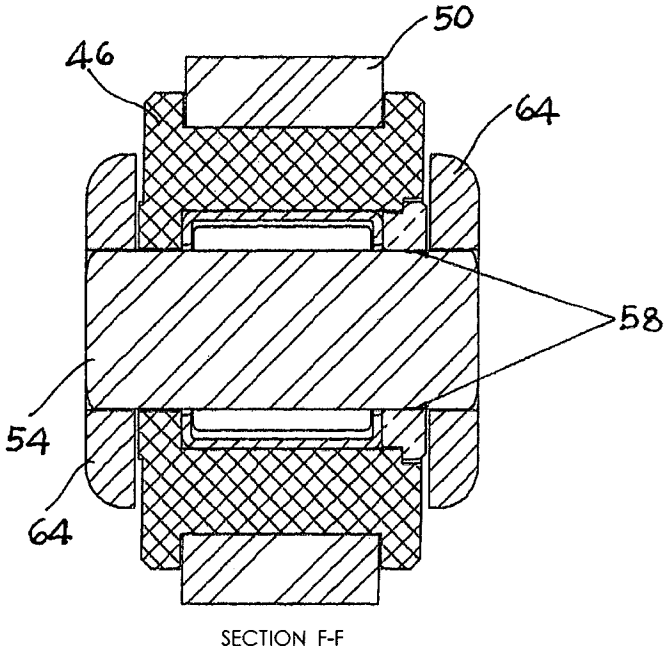
Figure 11:
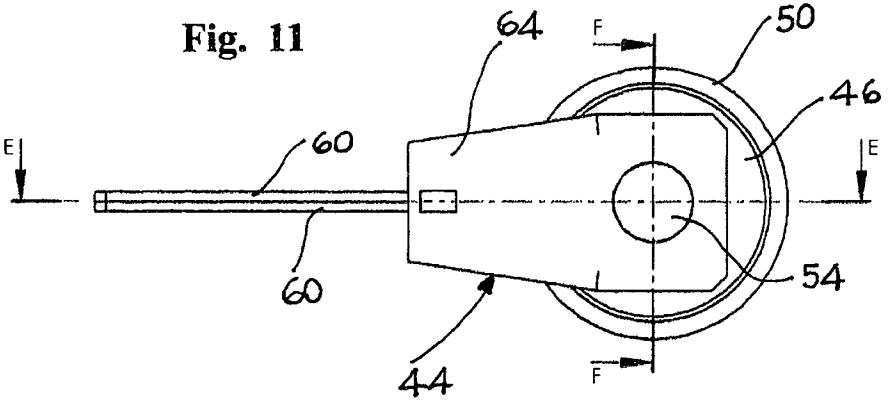
Figure 12:
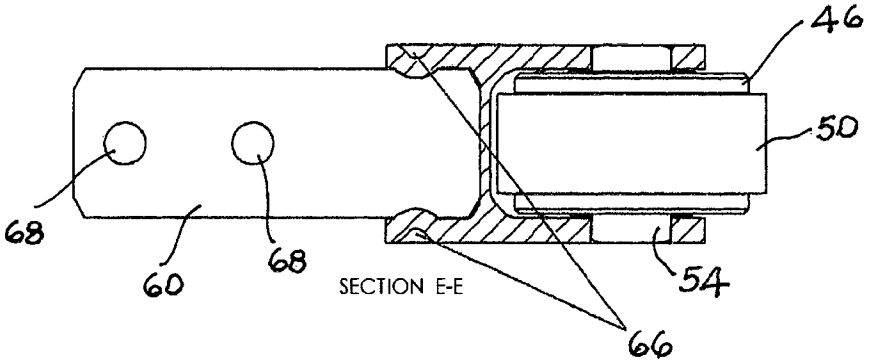
Figure 15:
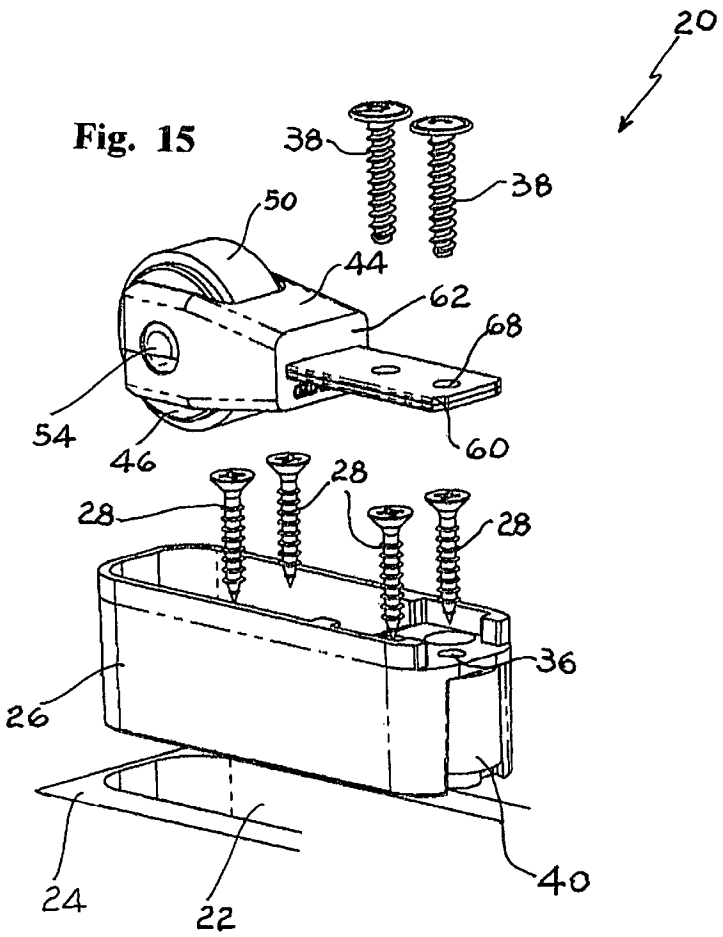
Figure 14:
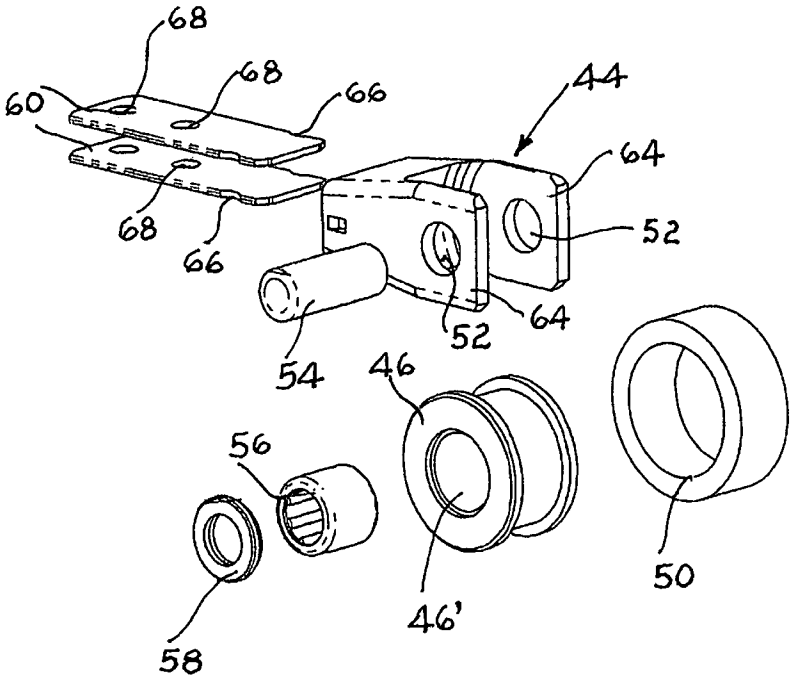
Figure 18:
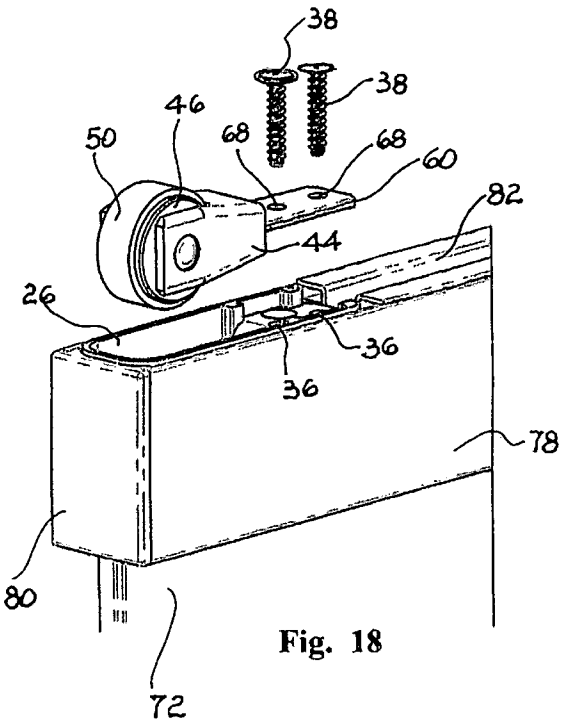
Figure 16:
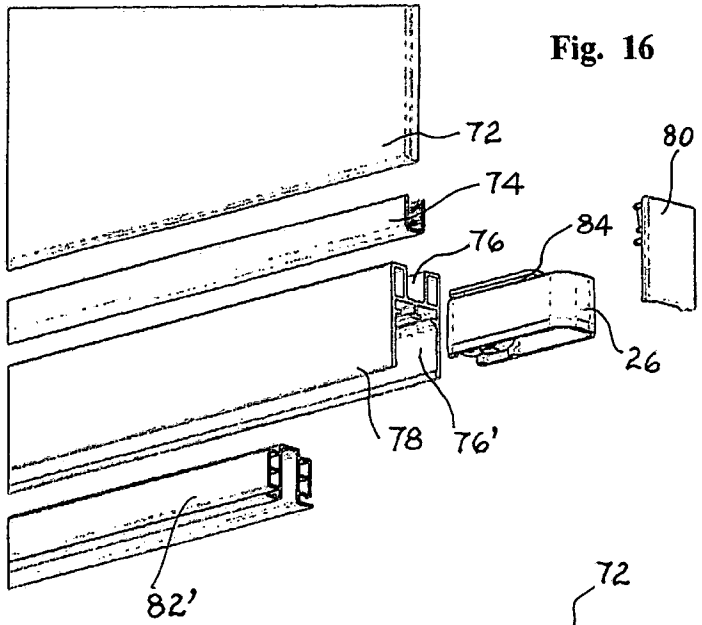
Figure 17:
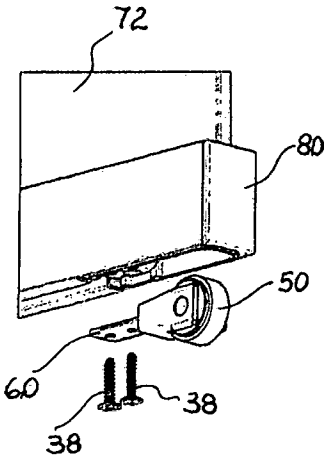

FIGS. 5A and 6A, related to the FIGS. 5 and 6 above, are respective partial magnifications, showing the movement of the device in the condition in which it is subjected to a vertical thrust;

FIG. 7 is a schematic axonometric view of the shell of the device according to the invention;

FIG. 8 shows schematically the same shell in a front view according to the figure above;

FIG. 9 is a longitudinal section along the C-C line of the shell of FIG. 8;

FIG. 10 is a longitudinal section along the D-D line of the shell of FIG. 8;

FIG. 11 is a schematic side view of the device of the invention removed from the shell;

FIGS. 12 and 13 are schematic views of said device in section, respectively along the E-E line and along the F-F line of FIG. 11;

FIG. 14 is a schematic exploded view of the device according to FIGS. 11-13;

FIG. 15 is a schematic exploded view of the device and its shell shown in an upside-down position with respect to FIG. 4A;

FIG. 16 is a schematic exploded view of the device according to the invention, used for the floor handling of glass doors instead of wooden ones;

FIG. 17 shows schematically an axonometric view of a part of the components of FIG. 16 mutually assembled;

FIG. 18 shows schematically the figure above in an upside-down and enlarged view.

With the initial reference to FIGS. 1, 2, 1A and 2A, the sliding doors floor handling device of this invention is secured to the lower edge of a door 10; in the description reference is made to a single sliding device, but it is understood that the door 10 comprises or may comprise, along its lower edge, a pair of sliding devices, positioned at the opposite ends of the door itself. In particular, said devices are arranged adjacent to the longitudinal slot 12 in which the guide profile section is arranged, indicated with 82, in which the pin or appendage 14 protruding from the floor is affixed, according to the known solution shown in FIGS. 1 and 1A; alternatively, the longitudinal slot 12 may be devoid of said guide profile section 82, whereby the pin or appendage 14 is fitted directly in the longitudinal slot 12 of the door 10. Said door 10 is placed next to a wall 16 and, in its upper part facing the wall itself, has a longitudinal downward extension 18 along which a guide profile section cooperating with carriages is secured to said wall for handling the door in the upper part, which are specific devices not belonging to the protection of this invention.

The device of the invention, indicated as a whole with 20 in FIGS. 4A and 15, is housed in a cavity 22 formed along the lower edge 24 of the door 10; said device comprises a shell 26 that constitutes the support and, preferably, defines a substantially parallelepiped-shaped container partially open along the upper side; the opposite lower side of the shell 26 intended to match the bottom wall of the cavity 22 is provided with a plurality of passing-through holes, preferably four, for the same number of screws 28 (FIGS. 3A, 8, 10 and 15) that secure the same shell 26 to the door 10, stabilizing it in the cavity 22. Said shell is advantageously made of plastic material by molding and has a window 30 on one of the sides or headers. Along the upper side, the shell 26 has a flat deployment zone 32 close to the edge, provided with two holes 34 having a diameter greater than that of the head of the screws 28; two further holes 36, aligned along the longitudinal axis of the shell 26, are arranged to receive as many screws 38 that constrain a support with a wheel to the same shell as discussed below. The side surface of an elastomer body 40 partially protrudes from the window 30, suitably shaped to be housed in the seat comprising the window 30, which is preferably in the shape of a circular portion; said body, which has the function of absorbing the possible shocks to which the shell 26 would be subjected if it finds, accidentally and violently, the guide appendage 14 protruding from the floor, is arranged in a special niche formed in the said shell and is established therein in any known manner, for example by forcing. In the shell 26 there is further a pad 42, also made of elastomer, for example in a cylindrical shape as shown in FIGS. 7-9, as well as 5A and 6A; said pad is housed under pressure in a seat made in the central-upper part of the shell 26. Said support provided with a wheel, shown in detail in FIGS. 4A and 11 to 15, comprises a fork-shaped frame 44, of metal or other suitable material, which supports a wheel 46 designed, when rolling, to touch the floor, indicated with 48 in FIGS. 5A and 6A. FIG. 14, in particular, shows said frame and the wheel 46, which is advantageously provided with a coating 50, consisting for example of a polyurethane material. This coating reduces the noise deriving from the sliding of the wheel 46 on the floor 48, especially in the presence of irregular stretches due to not perfectly aligned tile joints and avoids the formation on the floor 48 of traces due to the repeated passage of said wheel along the same line. As shown in detail in FIG. 14, the fork frame 44 is provided, on each of the opposite and parallel sections, with a passing-through hole 52, for the insertion of a metal pin 54 adapted to connect the wheel 46 to the frame itself. A roller bearing 56 is preferably inserted in the central hole 46' of said wheel, designed to increase both its sliding properties and its capacity. A locking ring 58, made of brass or other suitable material, is fitted under pressure on at least one of the opposite ends of the pin 54, to prevent the wheel from sliding out of the bearing 56 and the fork-shaped frame 44.

The fork-shaped frame 44 is joined to at least one elastic sheet 60, consisting of a rectangular-shaped metal plate, as can be seen in particular in FIGS. 4A, 11, 12 and 15; said sheet 60 defines a spring apt to flex both as a function of the stresses coming from the door 10 when sliding along the floor 48, and because of the weight of the door itself, which may be greater or smaller depending on the material used for its manufacture. According to a preferred embodiment, two overlapping elastic sheets 60 are coupled to the fork-shaped frame 44, as can be seen in particular from FIG. 14; in any case it is a hypothesis susceptible to variations, considering that said sheet can have any thickness, width and longitudinal development. The elastic sheet or sheets 60 are constrained to the fork-shaped frame 44 starting from the base of the frame itself, which frontally defines a flat surface, indicated with 62, orthogonal to the opposite and parallel sections 64. As can be seen in particular from FIG. 12, said sheets 60 are provided on the opposite sides, in a position close to one of the ends, of a recess 66, with a semicircular profile section, in which the metal material of the fork-shaped frame 44 is arranged, subject to a mechanical compression action; as a result of this action, therefore, the elastic sheets are firmly integrated into the fork-shaped frame 44.

The latter, provided with wheel 46 and with elastic metal sheets 60, is secured to the shell 26, as shown schematically in FIGS. 4A and 15. Said sheets, precisely overlapped, are provided with a pair of passing-through holes 68 in which the stem of corresponding screws 70 is inserted; the screws 70 are then screwed into the holes 38 of the shell 26. The wheel 46 and the associated fork-shaped frame 44 are consequently inserted into the shell itself, from the lower side of which they protrude in part to allow the wheel itself to roll along the floor 48. It should be noted that the assembly made by the wheel 46 and the fork-shaped frame 44 with the sheets 46 defines a single and invertible body, i.e. adapted to be integrated into the shell 26 without the need to follow a forced insertion direction, which avoids the danger of malfunctions and facilitates assembly.

FIGS. 5A and 6A show two possible positions of the wheel under more or less heavy load conditions, to highlight the damping and progressive effect caused by the elastic sheets 60. In particular, FIG. 5A shows a normal load condition, with the door 10 stationary or moving along a perfectly smooth floor 48; in this case, the wheel is not subjected to loads in addition to the weight of the door and the elastic sheet 60 secured to the shell 26 remain parallel to the floor itself. FIG. 6A, on the other hand, shows the condition in which the wheel undergoes a greater temporary load, due, for example, to an irregularity of the floor such as a gap between tiles; in order to absorb the overhang that manifests and attenuate the noise at the same time, the elastic sheets 60 bend, orienting upwards and consequently causing the wheel 46 to rise and tilt. If the irregularity of the floor is particularly marked, the lifting of the wheel is such that the fork-shaped frame 44 temporarily comes into contact with the pad 42, whose elastic properties produce a further attenuation of the effects of the load, while the substantial reduction of rolling noise is ensured by the coating 50 of the wheel 46.

FIGS. 16, 17 and 18 refer to the solution in which the device of the invention is applied to a glass or crystal door instead of a wooden one. In FIG. 16, the lower edge of a glass plate 72 is inserted in a known manner in a "U" shaped profile section 74, which in turn is housed in the longitudinal seat 76 of an underlying profile section 78; the latter accommodates a guide 82' below, having an internal conformation corresponding to the guide 82 of the wooden door 10, to match the pin 14 secured to the floor; in the lower part 76' of the latter, shaped upside down, the shell 26 is inserted and stabilized in a known manner. The fork-shaped frame 44, provided with wheel 46 and with elastic sheets 60, is then secured to the shell 26 with screws 38, in the same way as the previously described solution. FIG. 18, in particular, shows the shell 26 arranged in the profile section 78, as well as the holes 36 intended to house the screws 38 that connect to the shell itself the elastic sheets 60, coming out of the fork-shaped frame 44 bearing the wheel 46. Once assembled, a conventional plastic closing cap 80 is positioned on the opposed headers of the profile section 78. In the same lower part 76' of the profile section 78, said guide 82' is arranged for the appendage 14 protruding from the floor 48.

The shell 26, as shown in FIG. 16, is advantageously provided on the upper side with one or more plates 84, suitable for being secured, with screws or equivalent means, in the seat 76' of the profile section 78.

Also in the case of a door with glass or crystal, therefore, the device of the invention performs the same effective function described above in relation to the wooden doors, with results even more appreciable being generally the door with glass significantly heavier than that made of wood.

As can be seen from the foregoing, the advantages that the invention achieves are evident.

The sliding doors floor handling device of this invention allows effective absorption of vertical stresses and thrusts; the presence of a shock-absorbing element 40, which partly protrudes from the shell 26, prevents the door from being subjected to violent impacts when reaching the end of the stroke, while the elastomeric pad 42 and the coating 50 of the wheel 46 further dampen the vertical thrusts, thus reducing at the same time the noise deriving from the sliding of the wheel 46 on non-smooth areas of the floor 48.

Furthermore, the device of the invention can be easily installed, both on wooden and glass doors, away from possible malfunctions deriving from incorrect assembly.

Particularly advantageous is the possibility of manufacturing a single body consisting of the fork-shaped frame 44, the wheel 46 and the elastic sheets 60, which considerably facilitates the installation of the assembly.

Although the invention has been described above with reference to a possible embodiment thereof, given by way of non-limiting example, numerous changes and variations will be apparent to a person skilled in the art in the light of the above description. This invention, therefore, intends to embrace all changes and variations that fall within the spirit and in the protective scope of the following claims.

The invention claimed is:

1. A device for supporting a sliding door, said device comprising:

a containment shell substantially parallelepiped in shape, and having a top side and a bottom side opposite the top side, said bottom side provided with a recess;

a fork-shaped frame secured on the containment shell via one or more elastic sheets for resilient movement of the fork-shaped frame in the recess towards and away from the top side, said fork-shaped frame having parallel sections and a wheel mounted between the parallel sections via a pin, which is received in opposing holes provided in the parallel sections;

wherein the fork-shaped frame has a flat front side, orthogonal to the parallel sections of the fork-shaped frame, said one or more elastic sheets protruding from the front side and being permanently integrated into the fork-shaped frame via engagement of protrusions projecting from an inner face of the parallel sections in opposing recesses provided at an end of each one of the one or more elastic sheets; and an elastomer pad mounted in the recess between the fork-shaped frame and the top side for damping the movement of the fork-shaped frame.

2. The device according to claim 1, wherein the wheel is provided with a coating made of polyurethane material and a roller bearing, and wherein a locking ring is fitted under pressure at least on one end of said pin.

3. A device for supporting a sliding door, said device comprising:

a containment shell substantially parallelepiped in shape, and having a top side and a bottom side opposite the top side, said bottom side provided with a recess;

a fork-shaped frame secured on the containment shell via one or more elastic sheets for resilient movement of the fork-shaped frame in the recess towards and away from the top side, said fork-shaped frame having parallel sections and a wheel mounted between the parallel sections via a pin, which is received in opposing holes provided in the parallel sections;

an elastomer pad mounted in the recess between the fork-shaped frame and the top side for damping the movement of the fork-shaped frame;

wherein the one or more elastic sheets are mounted on a flat mounting surface formed on the bottom side of the containment shell, with screws extending through holes formed in the one or more elastic sheets and received in threaded bores provided in the mounting surface;

wherein the top side of the containment shell is provided with a plurality of through holes for securing the containment shell to the door with screws, said flat mounting surface having two bores for receiving a head of said screws; and wherein the containment shell comprises on one side a window from which the lateral surface of a cylindrical body in elastomer protrudes, provided with an axial hole in which the stem of one of the screws extends.

4. The device according to claim 3, wherein the wheel is provided with a coating made of polyurethane material and a roller bearing, and wherein a locking ring is fitted under pressure at least on one end of said pin.

5. A device for supporting a sliding door, said device comprising:

a containment shell substantially parallelepiped in shape, and having a top side and a bottom side opposite the top side, said bottom side provided with a recess;

a fork-shaped frame secured on the containment shell via one or more elastic sheets for resilient movement of the fork-shaped frame in the recess towards and away from the top side, said fork-shaped frame having parallel sections and a wheel mounted between the parallel sections via a pin, which is received in opposing holes provided in the parallel sections;

an elastomer pad mounted in the recess between the fork-shaped frame and the top side for damping the movement of the fork-shaped frame;

wherein the one or more elastic sheets are mounted on a flat mounting surface formed on the bottom side of the containment shell, with screws extending through holes formed in the one or more elastic sheets and received in threaded bores provided in the mounting surface;

wherein the top side of the containment shell is provided with a plurality of through holes for securing the containment shell to the door with screws, said flat mounting surface having two bores for receiving a head of said screws; and wherein the containment shell is securely arranged in a cavity formed along a lower edge of the door.

6. The device according to claim 5, wherein the wheel is provided with a coating made of polyurethane material and a roller bearing, and wherein a locking ring is fitted under pressure at least on one end of said pin.

7. A device for supporting a sliding door, said device comprising:

a containment shell substantially parallelepiped in shape, and having a top side and a bottom side opposite the top side, said bottom side provided with a recess;

a fork-shaped frame secured on the containment shell via one or more elastic sheets for resilient movement of the fork-shaped frame in the recess towards and away from the top side, said fork-shaped frame having parallel sections and a wheel mounted between the parallel sections via a pin, which is received in opposing holes provided in the parallel sections;

an elastomer pad mounted in the recess between the fork-shaped frame and the top side for damping the movement of the fork-shaped frame; and wherein the door is a glass door having a shaped profile section, and wherein the containment shell is arranged in a seat made in a lower part of the shaped profile section, and is secured in the seat through one or more plates provided on the top side of the containment shell.

8. The device according to claim 7, wherein the wheel is provided with a coating made of polyurethane material and a roller bearing, and wherein a locking ring is fitted under pressure at least on one end of said pin.

* * * * *